US009871312B2

(12) United States Patent
Guo

(10) Patent No.: US 9,871,312 B2
(45) Date of Patent: Jan. 16, 2018

(54) FOLDABLE PLUG AND ELECTRONIC DEVICE THEREOF

(71) Applicants: NANNING FUGUI PRECISION INDUSTRIAL CO., LTD., Nanning (CN); HON HAI PRECISION INDUSTRY CO., LTD., New Taipei (TW)

(72) Inventor: Yan-Li Guo, Shenzhen (CN)

(73) Assignees: NANNING FUGUI PRECISION INDUSTRIAL CO., LTD., Nanning (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/335,435

(22) Filed: Oct. 27, 2016

(65) Prior Publication Data

US 2017/0155204 A1 Jun. 1, 2017

(30) Foreign Application Priority Data

Nov. 26, 2015 (CN) ..... 2015 2 0957243

(51) Int. Cl.

| | |
|---|---|
| ***H01R 13/44*** | (2006.01) |
| ***H01R 13/04*** | (2006.01) |
| ***H01R 13/502*** | (2006.01) |
| ***H01R 13/60*** | (2006.01) |
| ***H01R 24/68*** | (2011.01) |
| *H01R 103/00* | (2006.01) |

(52) U.S. Cl.

CPC ..... *H01R 13/04* (2013.01); *H01R 13/502* (2013.01); *H01R 13/60* (2013.01); *H01R 24/68* (2013.01); *H01R 2103/00* (2013.01)

(58) Field of Classification Search

CPC ..... H01R 13/04; H01R 13/44; H01R 35/04; H01R 13/652; H01R 24/68; H01R 13/60; H01R 13/502

USPC ..... 439/131

See application file for complete search history.

(56) References Cited

U.S. PATENT DOCUMENTS

| | | | | |
|---|---|---|---|---|
| 5,628,641 A * | 5/1997 | Hahn | ..... | H01R 27/00 439/131 |
| 5,791,921 A * | 8/1998 | Lee | ..... | H01R 27/00 439/103 |
| 6,042,400 A * | 3/2000 | Queffelec | ..... | H01R 13/44 439/131 |
| 6,059,584 A * | 5/2000 | Mareno | ..... | H01R 35/04 439/131 |

(Continued)

*Primary Examiner* — Jean F Duverne

(74) *Attorney, Agent, or Firm* — ScienBiziP, P.C.

(57) ABSTRACT

A foldable plug and electronic device utilizing same are disclosed. The foldable plug includes a pair of socket sets, a connecting portion connecting the pair of socket sets, a pair of pins fitting into the pair of socket sets, and a pair of protrusions. Each pin is partly received in a socket set and partly exposed. The socket set has a surface facing away from the connecting portion, and the protrusion extends from the surface facing away from the connecting portion. Each protrusion includes a first surface, a second surface, and a third surface, all adjacent. The first surface, the second surface, and the third surface are connected with each other. The foldable plug and electronic device can utilize space within electronic device effectively.

10 Claims, 8 Drawing Sheets

(56) References Cited

U.S. PATENT DOCUMENTS

| | | | | |
|---|---|---|---|---|
| 6,062,880 | A * | 5/2000 | Skuza | H01R 24/68 439/131 |
| 6,190,184 | B1 * | 2/2001 | Cimbal | B26B 19/382 439/131 |
| 6,494,727 | B2 * | 12/2002 | Wen-Ching | H01R 35/04 439/131 |
| 6,632,098 | B1 * | 10/2003 | Wong | H01R 24/68 439/131 |
| 6,835,903 | B1 * | 12/2004 | Liu | H01R 13/44 200/293 |
| 7,354,286 | B1 * | 4/2008 | Lee | H01R 13/652 439/131 |
| 7,549,877 | B1 * | 6/2009 | Vista, Jr. | H01R 13/6675 439/172 |
| 8,366,461 | B2 * | 2/2013 | Lee | H01R 24/30 439/131 |
| 9,077,093 | B1 * | 7/2015 | Roy | H02K 49/10 |

* cited by examiner

FOLDABLE PLUG AND ELECTRONIC DEVICE THEREOF

The present disclosure generally relates to an electrical connector; and more particularly to an electrical connector having a foldable plug; and an electronic device with the foldable plug.

BACKGROUND

Modern devices tend to be miniaturized. Because a plug is an indispensable element for connecting the electronic devices to the power supplies, designers try to reduce the footprint of the plug. To save space inside electronic devices, conventional foldable plugs usually have three pins, which include two conductive pins and a ground pin. The three pins of the plug are arranged in triangle shape. When the plug is received in the electronic device, the plug occupies large interior space of the device, which increases the overall size of the electronic device and reduces portability of the device.

BRIEF DESCRIPTION OF THE DRAWINGS

Implementations of the present technology will now be described, by way of example only, with reference to the attached figures, wherein.

DETAILED DESCRIPTION

Figure 1:
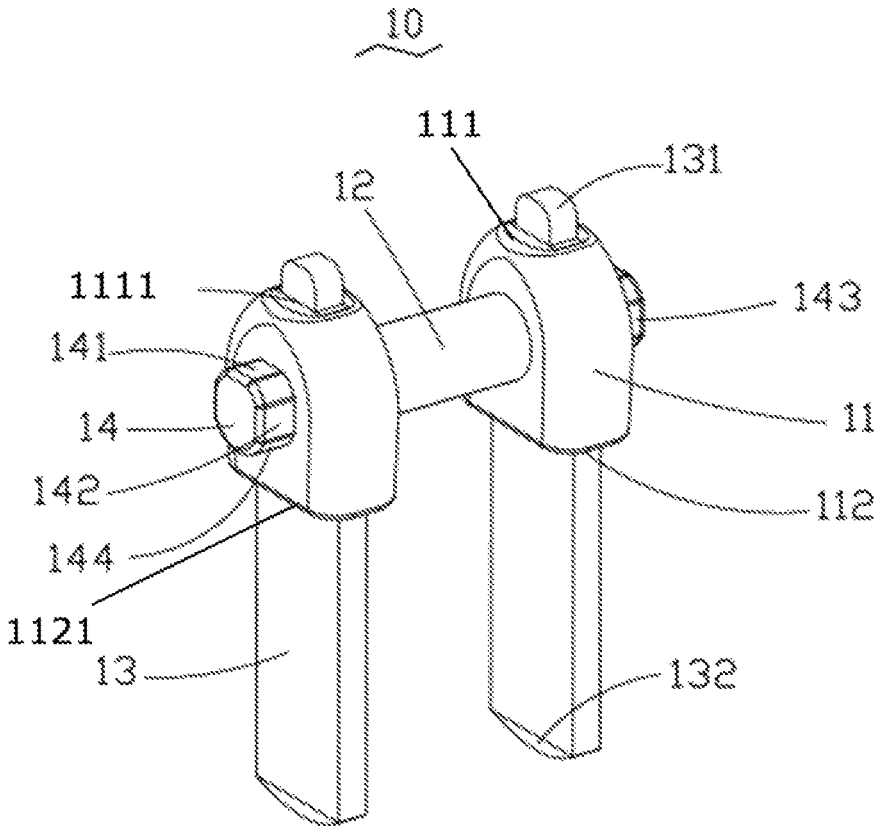
FIG. 1 is a perspective view of a foldable plug in one exemplary embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain portions have been exaggerated to better illustrate details and features of the present disclosure.

As shown in FIG. 1, a foldable plug 10 includes a pair of socket sets 11, a connecting portion 12, a pair of pins 13, and a pair of protrusions 14. The connecting portion 12 connects the pair of socket sets 11. Each pin 13 corresponds to fit into one of the socket sets 11. The foldable plug 10 can be electrically connected to an external power supply through the pins 13.

Each socket set 11 has a first end 111 and a second end 112, a first opening 1111 is defined on the first end 111, and a second opening 1121 is defined on the second end 112. The cross-section of the first opening 1111 is smaller than the cross-section of the second opening 1121.

Each pin 13 is partly received in the socket set 11 and partly exposed out of the socket set 11. Each pin 13 includes a first end 131 and a second end 132. The first end 131 of the pin 13 is inserted into the socket set 11 through the second opening 1121 until it extends at least partially out of the socket set 11 through the first opening 1111. That is, the first end 131 of the pin 13 is exposed out of the socket set 11 through the first opening 1111, and the second end 132 is exposed out of the socket set 11 through the second opening 1121.

The socket set 11 has a surface facing away from the connecting portion 12, and the protrusion 14 extends from the surface facing away from the connecting portion 12. The protrusion 14 has a first surface 141, a second surface 142, and a third surface 143. The first surface 141, the second surface 142, and the third surface 143 are adjacent surfaces with respect to each other. The first surface 141, the second surface 142, and the third surface 143 are connected to each other by arced surfaces 144. The first surface 141 is located between the second surface 142 and the third surface 143. The first surface 141 is perpendicular to an extending direction of the pair of pins 13. The second surface 142 and the third surface 143 are parallel to the extending direction of the pair of pins 13.

Figure 2:
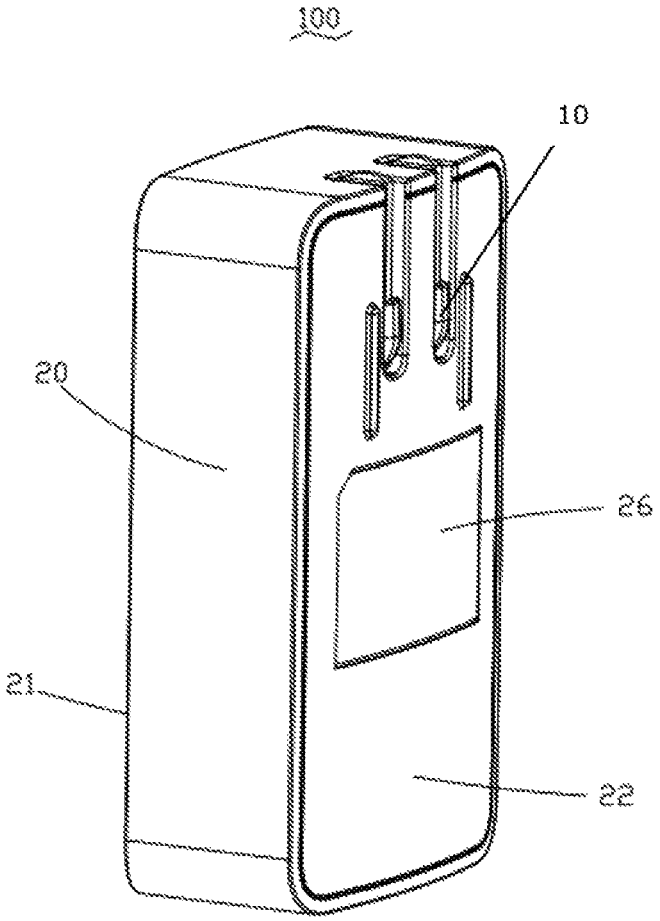
FIG. 2 is a perspective view of an electronic device showing the foldable plug of FIG. 1 in a folded state in one exemplary embodiment of the present disclosure, and the electronic device includes a bracket and a base.
Figure 3:
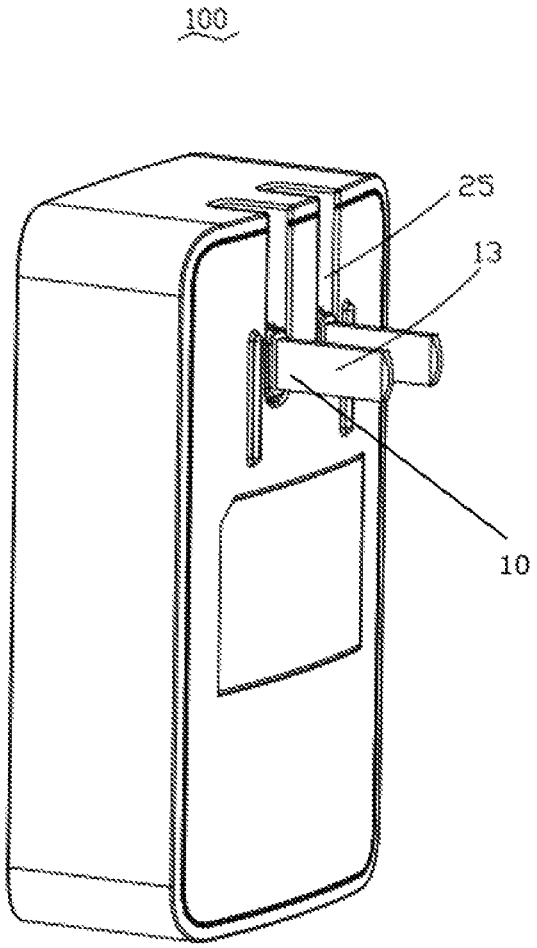
FIG. 3 is a perspective view of the electronic device of FIG. 2 showing the foldable plug in an operable state.

FIG. 2 and FIG. 3 respectively show an electronic device 100 in a folded state and in an operable state. The electronic device 100 includes the above-mentioned foldable plug 10 and a shell 20. The foldable plug 10 is rotatably attached to the shell 20 to place the pins 13 in or exposed from the shell 20. The electronic device 100 can be a wireless intelligent controller, wireless repeater, signal amplifier, or the like to an unlimited extent.

Figure 4:
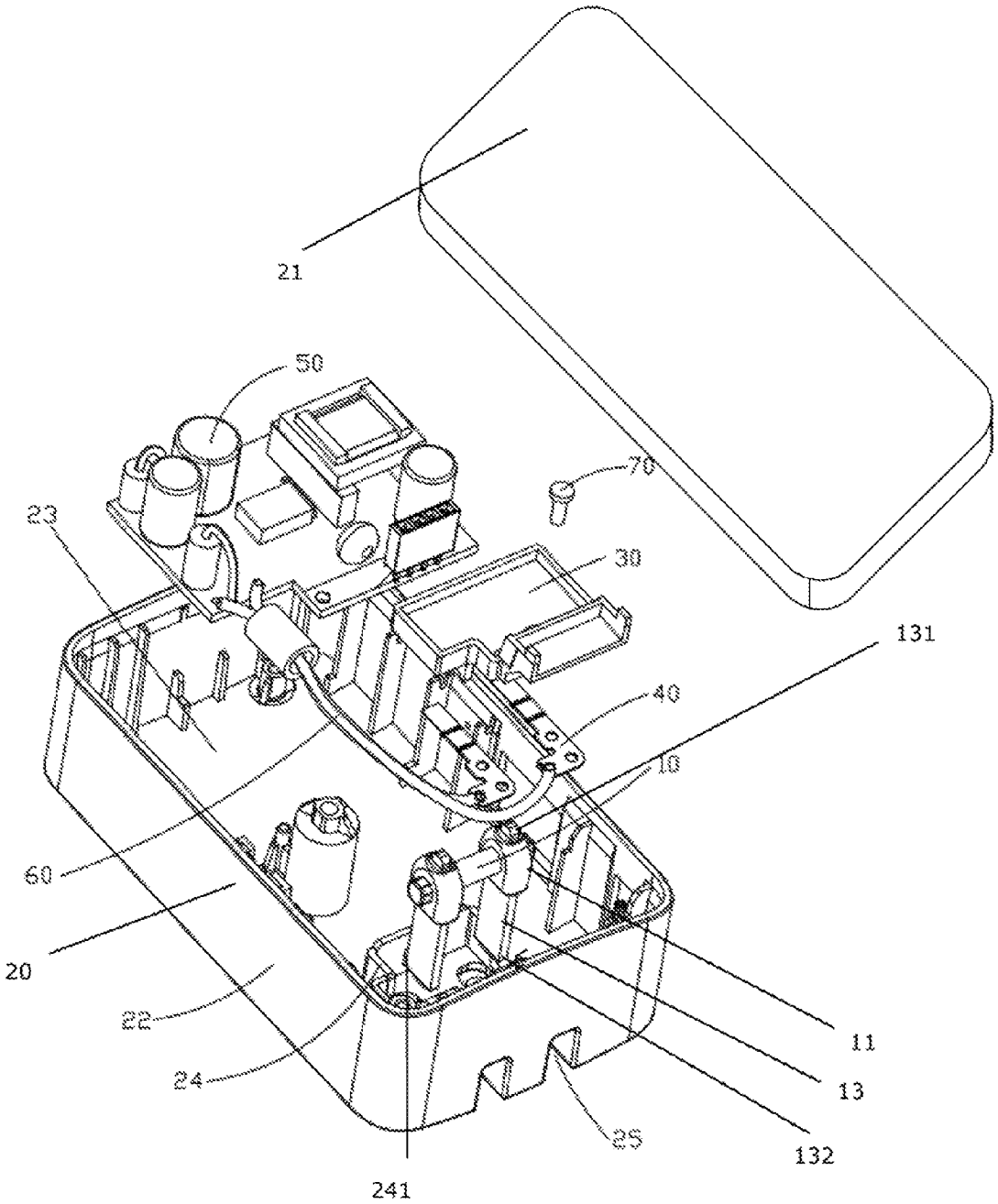
FIG. 4 is an exploded view of the electronic device of FIG. 2.

In FIG. 4, the shell 20 is rectangular and includes an upper cover 21 and a lower cover 22. The lower cover 22 is latched to the upper cover 21. The upper cover 21 and the lower cover 22 define a receiving space 23. A surface of the lower cover 22 facing the upper cover 21 extends upward to form a base 24. The base 24 has a buckle 241 and the foldable plug 10 is received in the base 24. The lower cover 22 defines a pair of receiving slots 25 to correspondingly receive the pair of pins 13. The second end 132 of the pin 13 is exposed out of the shell 20 and the socket set 11 is partly exposed out of the shell 20. When the foldable plug 10 is folded, the pins 13 are received in the receiving slots 25, which improves portability of the electronic device 100.

Additionally, in FIG. 2, an outer surface of the lower cover 22 of the shell 20 is provided with sticker.

The electronic device 100 further includes a bracket 30, an elastic gasket 40, a power module 50 electrically connecting to the elastic gasket 40, and a cable 60 connecting the elastic gasket 40 to the power module 50. The bracket 30, the elastic gasket 40, the power module 50, and the cable 60 are all received in the shell 20.

Figure 5:
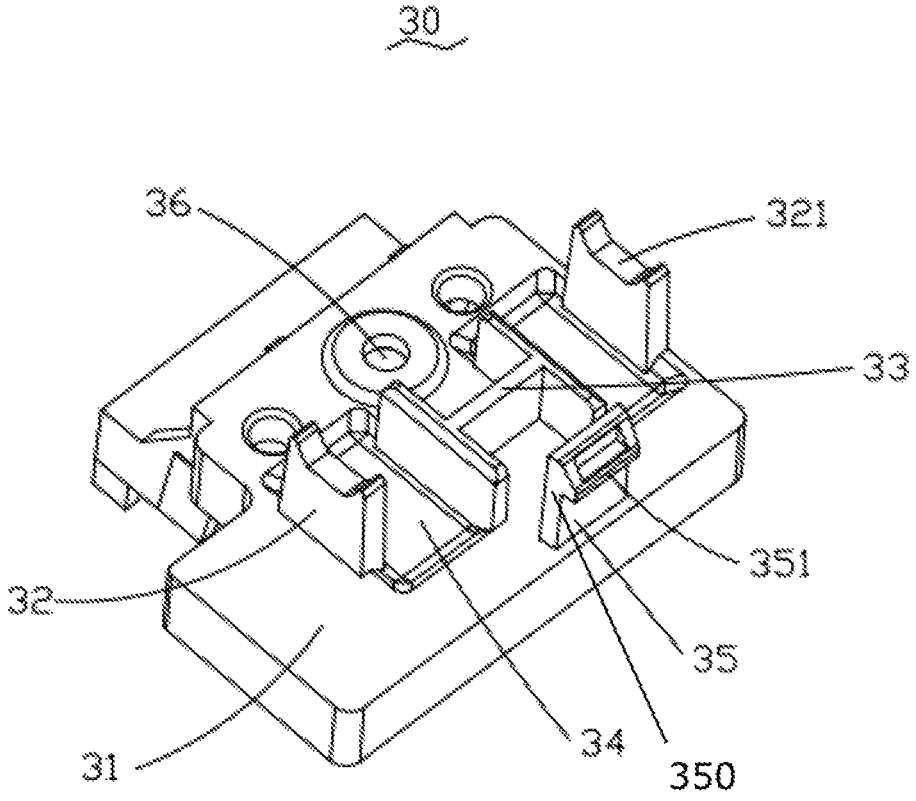
FIG. 5 is a perspective view of the bracket of FIG. 2.

FIG. 4 and FIG. 5 show that bracket 30 includes a body 31, a pair of posts 32, an insulating portion 33, a pair of slots 34, a hook 35, and a mounting hole 36. The pair of posts 32 extends perpendicularly from the body 31. Each post 32 has an end portion 321, which is substantially U shaped. The insulating portion 33 is located between the pair of posts 32.

The insulating portion 33 has two ends. One of the posts 32 and one end of the insulating portion 33 define the slot 34. The other post 32 and the other end of the insulating portion 33 define the other slot 34. The first end 131 of the pin 13 is received in the slot 34. The hook 35 perpendicularly extends from a side edge of the body 31. The hook 35 has an end 350. The end 350 of the hook 35 extends away from the body 31 to form a latching portion 351. In this exemplary embodiment, the posts 32, the insulating portion 33, and the hook 35 are all on the same side of the body 31.

Figure 6:
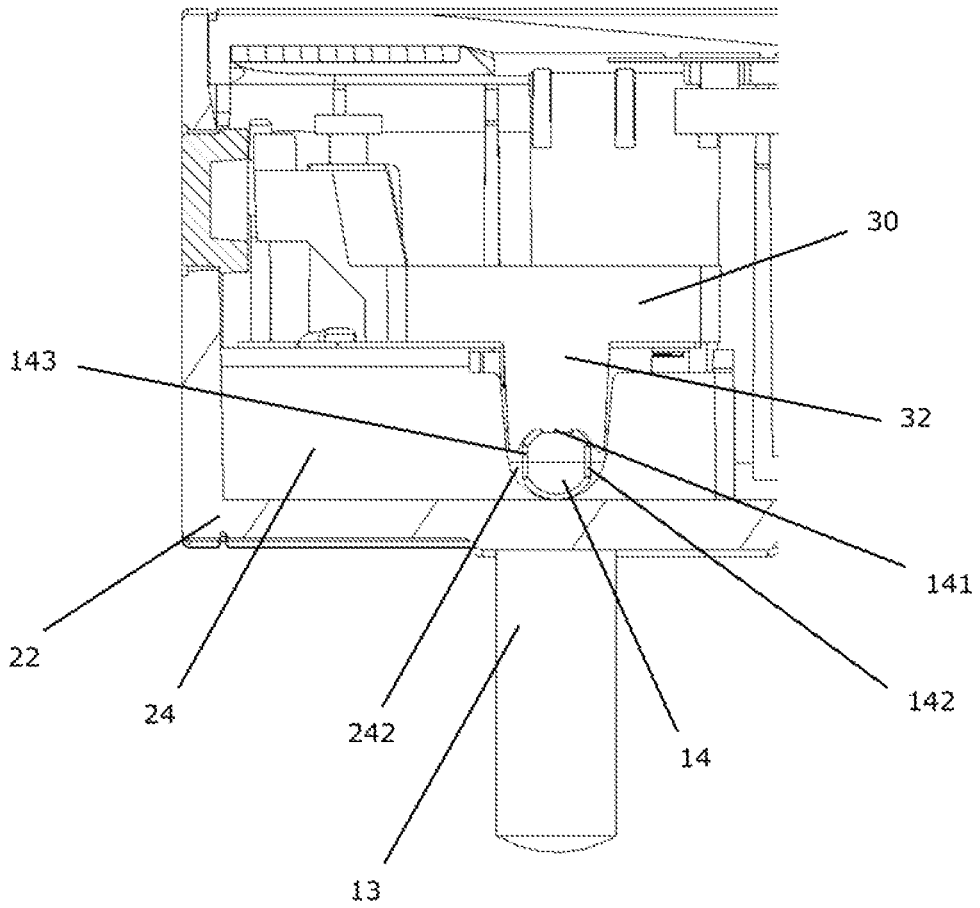
FIG. 6 is a cross-sectional view showing the assembly drawing of the bracket and the base of FIG. 2 in the operable state.

Referring to FIGS. 4, 5 and 6, the latching portion 351 is latched to the buckle 241 of the base 24. A fastener 70 (such as a screw) can be inserted into the mounting hole 36 to fasten the bracket 30 in the shell 20. Each post 32 and the base 24 define a rotating space 242, and each protrusion 14 is received in the rotating space 242 and each protrusion 14 can rotate in the rotating space 242. The ending portion 321 corresponds to receive each protrusion 14 of the foldable plug 10. When one of the first surface 141, the second surface 142, or the third surface 143 makes contact with the ending portion 321, the pin 13 is in a different position. In detail, when the first surface 141 is parallel to the ending portion 321, the pin 13 is perpendicular to the shell 20, and the electronic device 100 is in a state of use. When the second surface 142 or the third surface 143 is parallel to the ending portion 321, the pin 13 is received in the receiving slot 25 of the shell 20 and the foldable plug 10 is folded.

The elastic gasket 40 is located between the foldable plug 10 and the bracket 30. When the foldable plug 10 is fastened to the base 24 in the body 31 and the device is in use, the first end 131 of the pin 13 is electrically connected to and pressed against the elastic gasket 40. The elastic gasket 40 is electrically connected with the power module 50 through the cable 60 to connect the pin 13 to the power module 50.

Figure 7:
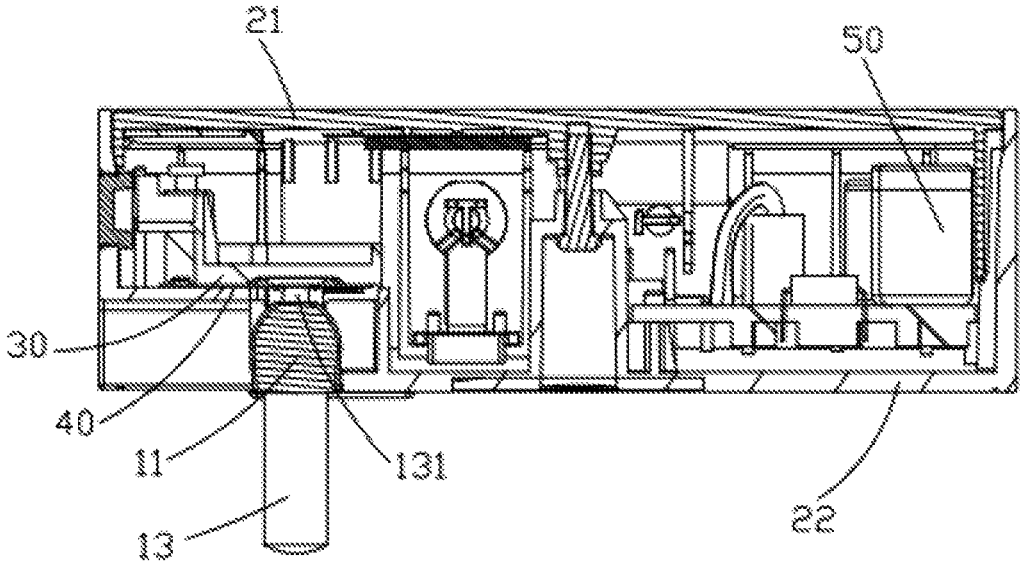
FIG. 7 is a cross-sectional view of the electronic device of FIG. 2 in the operable state.
Figure 8:
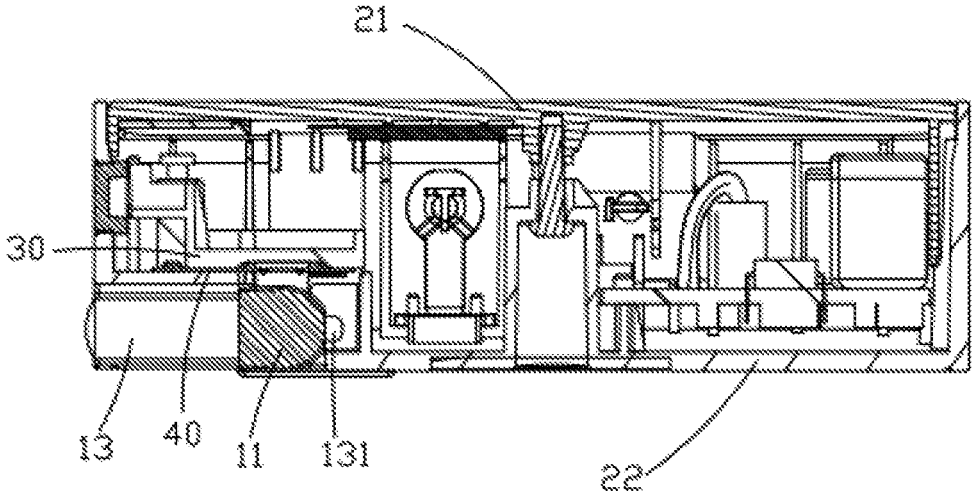
FIG. 8 is a cross-sectional view of the electronic device of FIG. 7 in the folded state.

FIG. 7 is a cross-sectional view of the electronic device of FIG. 2 in the operable state. FIG. 8 is a cross-sectional view of the electronic device of FIG. 7 in the folded state. The foldable plug 10 is mounted on the base 24 of the shell 20, and the second end 132 of the pin 13 and a portion of the socket set 11 are exposed from the shell 20 through the receiving slot 25. The pin 13 is perpendicular to the shell 20, which is in an original state. The elastic gasket 40 is located on the first ends 131 of the pins 13 and electrically connected to the power module 50 through the cable 60. The bracket 30 is latched to the foldable plug 10 to allow the first end 131 to be received in the slot 34. The protrusion 14 is received in the rotating space 242. When the hook 35 is latched to the buckle 241 of the base 24 and the fastener 70 screws into the mounting hole 36, the bracket 30 is mounted to the lower cover 22. Then, the upper cover 21 is latched to the lower cover 22.

When the foldable plug 10 is in the original state, the pins 13 are perpendicular to the shell 20. When the first surface 141 of the protrusion 14 is parallel to the ending portion 321, the first end 131 connects to the elastic gasket 40. When the second end 132 of the pin 13 is inserted into the external power source, the pin 13 is electrically connected to the elastic gasket 40 and the power module 50. When the foldable plug 10 is folded, the pin 13 is received in the receiving slot 25, and the second surface 142 or the third surface 143 of the protrusion 14 is parallel to the ending portion 321. The first end 131 of the pin 13 is thus disconnected from the elastic gasket 40.

The foldable plug 10 and the electronic device 100 having the foldable plug 10 are convenient to use, and can use space of electronic device more effectively. Miniaturization of electronic devices 100 through the rotation of the foldable plug 10 is promoted.

The exemplary embodiments shown and described above are only examples. Many details are often found in the art such as the other features of foldable plug and electronic device thereof. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the portions within the principles of the present disclosure, up to and including the full extent established by the broad general meaning of the terms used in the claims. It will therefore be appreciated that the exemplary embodiments described above may be modified within the scope of the claims.

What is claimed is:

1. A foldable plug, comprising:

a pair of socket sets;

a connecting portion connecting the pair of socket sets, wherein each socket set having a surface facing away from the connecting portion;

a pair of pins correspondingly fitting into the pair of socket sets, and each pin is partly received in and partly exposed from one socket set; and a pair of protrusions, comprising:

a first flat surface;

a second flat surface;

a third flat surface; and a plurality of arced surface;

wherein the socket set has a surface facing away from the connecting portion, and the protrusion extends from the surface facing away from the connecting portion; the first flat surface, the second flat surface, and the third flat surface are adjacent surface with respect to each other; and wherein at least one arced surface is positioned and connected between two of the first flat surface, the second flat surface, and the third flat surface.

2. The foldable plug of claim 1, wherein the pin includes a first end and a second end, each socket set has two ends, a first opening is defined on one end, and a second opening is defined on the other end; wherein the first end of the pin is inserted into the socket set through the second opening until first end of the pin extends at least partially out of the socket set, and the second end is exposed out of the socket set through the second opening.

3. The foldable plug of claim 2, wherein a cross-section of the first opening is smaller than a cross-section of the second opening.

4. The foldable plug of claim 1, wherein the first flat surface is located between the second flat surface and the third flat surface, the first flat surface is perpendicular to an extending direction of the pair of pins and the second flat surface and the third flat surface are parallel to an extending direction of the pair of pins.

5. An electronic device, comprising:

the foldable plug of claim 1;

a shell; and a bracket supporting the foldable plug, comprising:

a pair of posts perpendicularly extended from the body;

wherein each post has an end portion, and the end portion and the shell define a rotating space; and the foldable plug and the bracket are mounted on the shell, the foldable plug is rotatably assembled with the shell; and wherein when the protrusion is rotated in the rotating space such that one of the first flat surface, the second flat surface or the third flat surface is parallel to the ending portion; and wherein the pin rotates at a different angle relative to the shell.

6. The electronic device of claim 5, wherein the shell includes an upper cover and a lower cover latched to the upper cover; and wherein the upper cover and the lower cover form a receiving space to receive the foldable plug and the bracket.

7. The electronic device of claim 6, wherein the lower cover defines a pair of receiving slots to receive the pair of pins, and the second end of the pin is exposed from the shell through the receiving slot;

wherein when the first flat surface is parallel to the ending portion, the pin is perpendicular to the shell; and wherein when the second flat surface or the third flat surface is parallel to the ending portion, the pin is received in the receiving slot of the shell.

8. The electronic device of claim 7, wherein the electronic device further includes an elastic gasket and a power module electrically connecting to the elastic gasket; and the elastic gasket is located between the foldable plug and the bracket; wherein when the pin is perpendicular to the shell, the elastic gasket is electrically connected to the pin and the pin is electrically connected to the power module.

9. The electronic device of claim 6, wherein a hook perpendicularly extends from a side edge of the body and the hook is latched to a buckle of the lower cover to fix the bracket in the lower cover.

10. The electronic device of claim 5, wherein the ending portion of the bracket is substantially U-shaped.

* * * * *